US008807534B2

(12) United States Patent
Guyard

(10) Patent No.: US 8,807,534 B2
(45) Date of Patent: Aug. 19, 2014

(54) TELESCOPIC LIFTING DEVICE WITH SAFETY STRAP

(75) Inventor: Francois-Xavier Guyard, Chambon sur Cisse (FR)

(73) Assignee: Talbot Decoupage Emboutissage, Mer (FR)

( * ) Notice: Subject to any disclaimer, the term of this patent is extended or adjusted under 35 U.S.C. 154(b) by 30 days.

(21) Appl. No.: 13/356,870

(22) Filed: Jan. 24, 2012

(65) Prior Publication Data

US 2012/0181494 A1 Jul. 19, 2012

(51) Int. Cl.
*B66D 1/36* (2006.01)

(52) U.S. Cl.
USPC ..... 254/337; 212/296; 212/348

(58) Field of Classification Search
USPC ..... 254/335, 336, 337, 338; 212/347, 348, 212/350, 296, 299
See application file for complete search history.

(56) References Cited

U.S. PATENT DOCUMENTS

| | | | | |
|---|---|---|---|---|
| 5,018,933 | A * | 5/1991 | Kramer | 414/542 |
| 8,191,322 | B2 * | 6/2012 | Liestenfeltz et al. | 52/212 |
| 2004/0026675 | A1 * | 2/2004 | Green et al. | 254/326 |

* cited by examiner

*Primary Examiner* — Emmanuel M Marcelo
*Assistant Examiner* — Angela Caligiuri
(74) *Attorney, Agent, or Firm* — Bachman & Lapointe, P.C.

(57) ABSTRACT

A lifting device with a telescopic pole having at least three successive modules mounted so that the modules can slide vertically with respect to each other. A drive strap transfers movement in order to extend an upper module with respect to an intermediate module when the intermediate module is caused to move with respect to a lower module of the modules. The drive strap is kept taut between two fixation points placed respectively on the lower module and upper modules and pass along a return pulley device mounted on the intermediate module. A safety system is normally maintained in inactive position by tension of the drive strap is automatically released into active locking position to prevent the upper module from continuing to move with respect to the intermediate module if the drive strap breaks.

2 Claims, 8 Drawing Sheets

Fig. 1
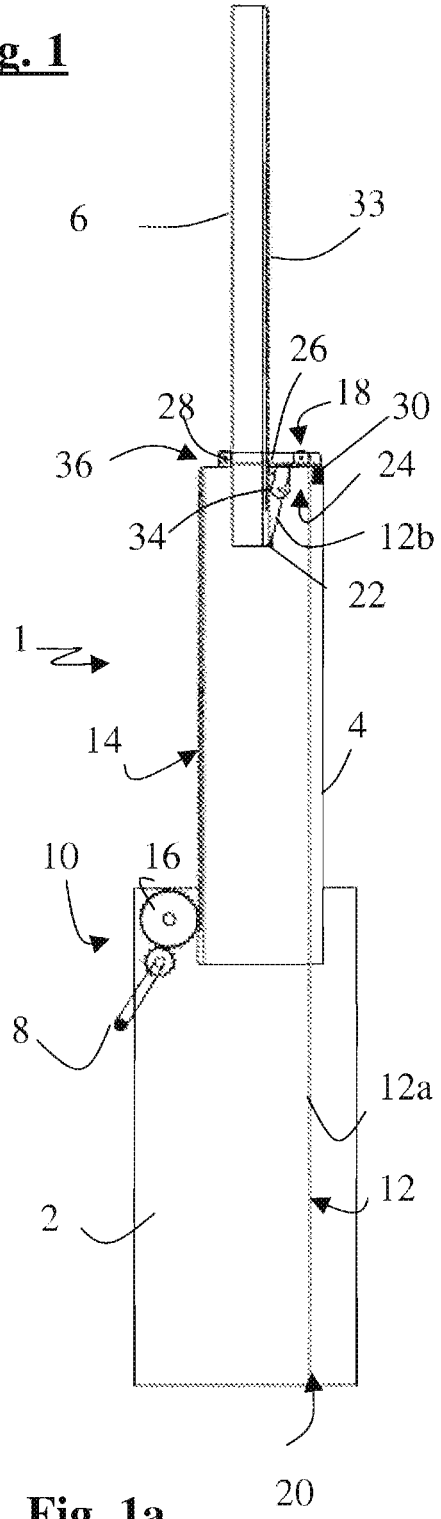
Fig. 1a
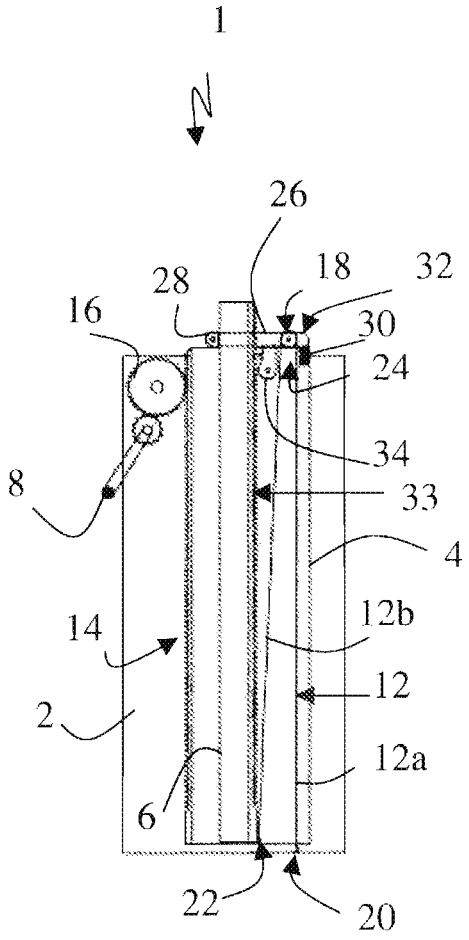
Fig. 1b

Fig. 7
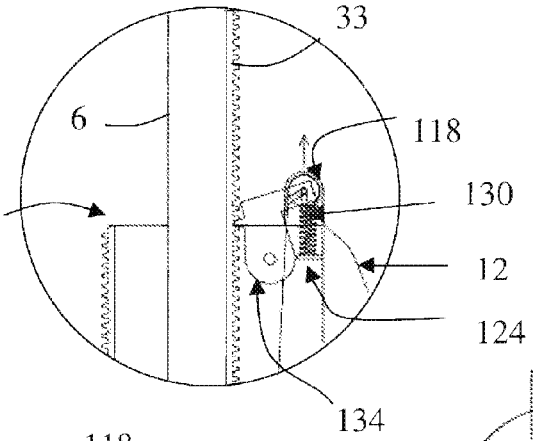
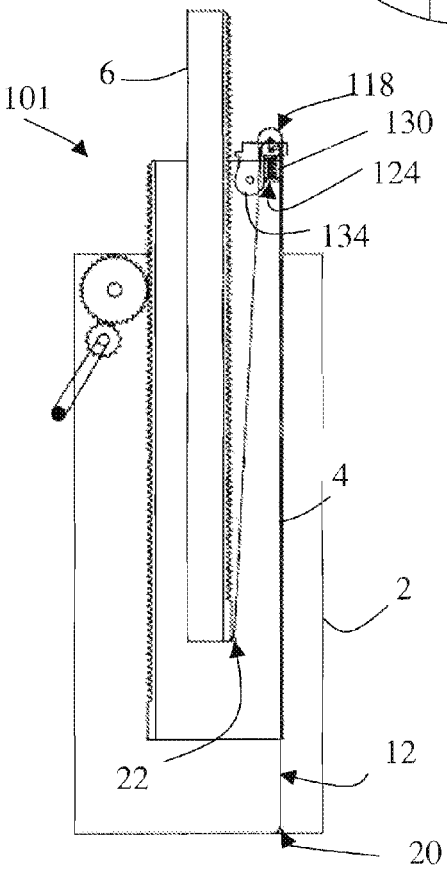
Fig. 5
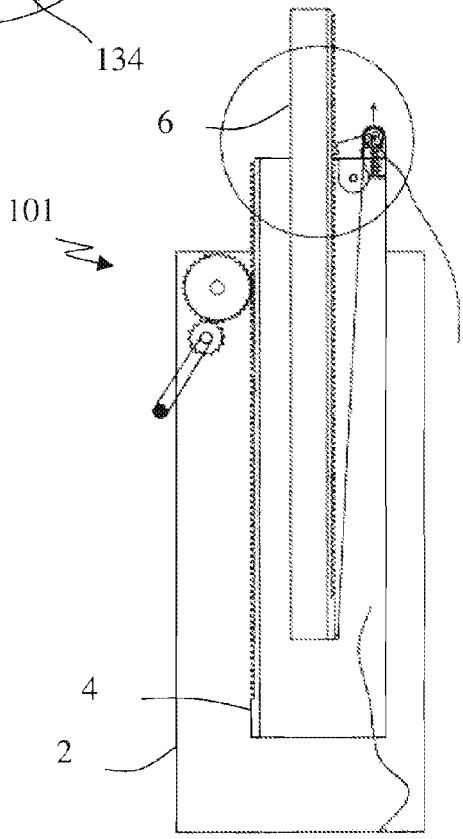
Fig. 6

Fig. 15
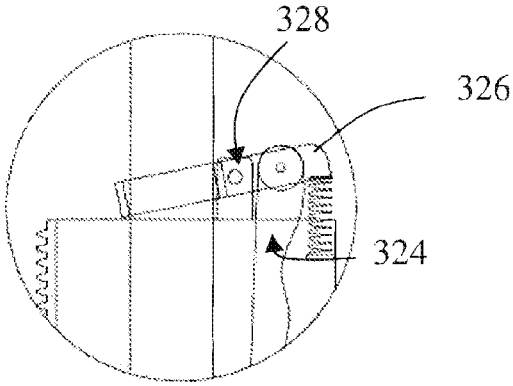
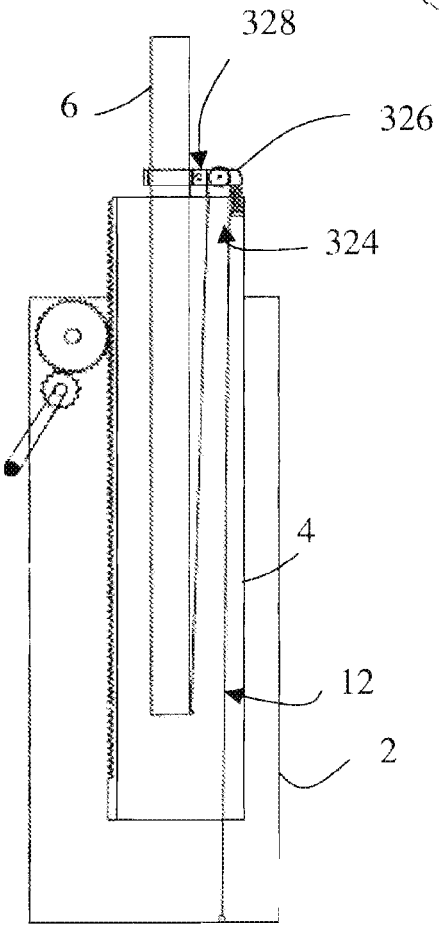
Fig. 13
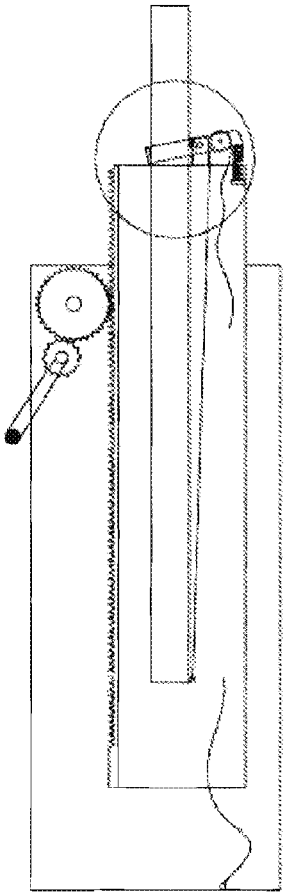
Fig. 14

Fig. 16
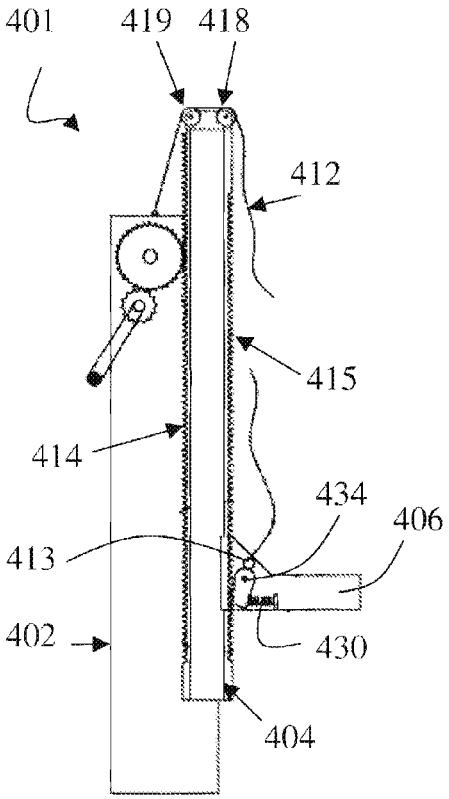
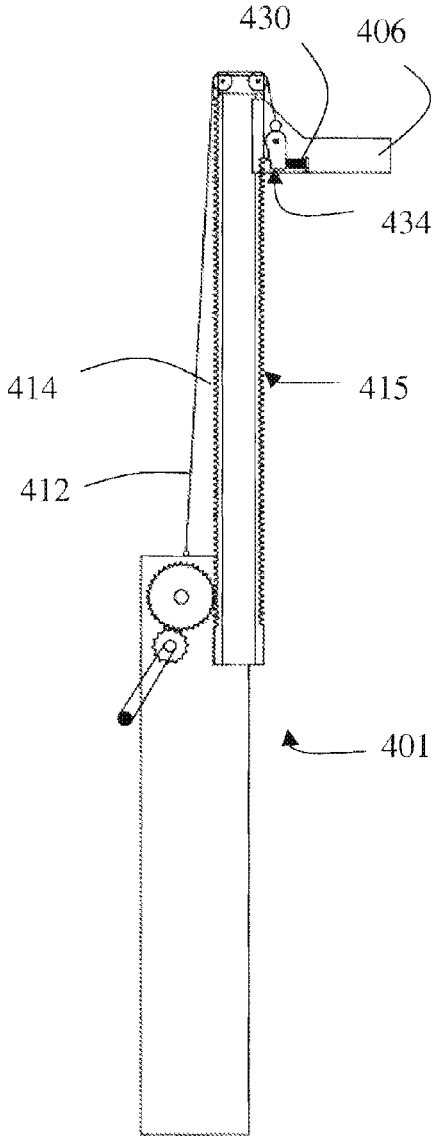
Fig. 17

TELESCOPIC LIFTING DEVICE WITH SAFETY STRAP

BACKGROUND

This invention concerns the design and construction of a lifting device with a telescopic pole which is at least partly of the strap lift type. The device can vertically displace a load over several meters. It consists of a telescopic pole that can be equipped, as needed, at the base, with a stand system and, at the top, with any system that will allow the load to be attached or handled.

Telescopic lifting devices already exist which comprise modules that slide vertically over each other and in which the movement of an upper module with respect to a lower module is obtained by one or several cables connecting up the modules. Extension of the system and vertical displacement of the load attached to the upper module are obtained by means of a tensile force exerted on the crank handle of a winch fixed to the outside of the lower module and the base of the device and to which the end of one of the cables is connected.

To meet safety standards, mechanical means must be provided to lock the modules in extended position and thus prevent accidents occurring, due to breaking of the cable, for example. Manual installation of mechanical locking systems, such as passing a pin through the module to be locked, presents a risk if the operator who wishes to remove the device forgets to deactivate the said locking system. The operator could also turn the crank handle, thus unwinding several dozen centimeters of cable, before realizing that the locking system has not been deactivated. The resulting cable slack can then get stuck inside the telescopic system and break causing the load to fall suddenly when the operator releases the mechanical locking system.

A winch-driven cable has the disadvantage of requiring a complex set of pulleys which generates a large amount of friction, requiring both additional effort on the part of the operator to lift the load and a much longer load lifting time. The cable is also exposed to a number of risks such as crushing, pinching and corrosion, which rapidly reduces its life time and requires costly regular maintenance operations. At the extreme, the cable can break and cause accidents.

SUMMARY OF THE INVENTION

The invention is aimed at avoiding these pitfalls by means of a lifting device with a telescopic pole in which the force exerted by the operator turning the crank handle that adjusts the height of the telescopic pole is directly transmitted to the sliding connection between two different modules, without having to use a cable wound in successive coils around a winch reel. No longer using a cable wound around a winch eliminates a major disadvantage of the winch system arising from variations in the force exerted by the operator to lift a given load over a given distance. The length of cable which must be pulled by the operator each time depends on the developed length of the turn, which varies according to the number of successive turns on the winch reel around which the cable is wound.

In a lifting device with direct transmission of force to control displacement of an upper element of the module with respect to a lower element of the module which is the subject of a European patent filed on the same date by the same applicant company and the same inventor, a mechanical rack and pinion direct drive system is used in which the transmission of movement between a rotating crank handle on the lower element of the reference module, or fixed base module, and a rack solid with the upper element of the module is conventionally provided by a rotating pinion gear train cooperating with the tooth of the rack. In conjunction with the above mechanical rack and pinion direct drive system, the lift mechanism is usefully protected with an anti-return locking system which is automatically triggered during extension of the telescopic pole by friction coupling with a pinion in the gear train ensuring transmission of the movement of the crank handle mounted on the lower element so that it is accessible from the outside, to the rack solid with the upper element.

The invention identified in the present European patent application, on the other hand, refers to a lift device in which the drive force is transferred by a strap which is also completed with a safety device so that the use of the telescopic system is made particularly safe for the operator.

According to the invention, the safety strap is kept taut between two fixation points on two different modules of the telescopic system, more especially placed respectively on a lower module and at the lower end of an upper module, and passing around a return pulley. In a telescopic stage with three successive modules sliding one over the other, the return pulley is usefully supported by an intermediate module between the lower module and the upper end of the upper module. The strap is thus mounted so that it causes the upper module (or lower module of the telescopic stage concerned) to be displaced with respect to the intermediate module whenever the intermediate module is displaced with respect to the first of the three modules, or the lower module.

Operation of the safety device associated with the strap is based on whether or not the strap is taut. It entails a locking system to prevent displacement of the upper module which stops it from moving with respect to the previous module if the strap breaks (or is no longer taut). The locking system above is usefully maintained in inactive position during normal operation by the effect of the taut strap on a lever subjected to the elastic return action of a spring. As soon as the strap breaks, the active position is automatically triggered to prevent continuing displacement of the upper module with respect to the intermediate module which immediately precedes it in a telescopic stage with three successive modules.

A passive locking system is thus usefully obtained which is particularly effective because it is activated as soon as the strap breaks, and its implementation and removal cannot be forgotten unintentionally.

Depending on different features of the invention which will either be implemented separately or in combination in different embodiments for the telescopic lifting device with safety strap according to the invention, the following choices will be made in accordance with each specific application:

- The safety device in the event of breaking of the strap comprises a locking system to prevent displacement of the module which is hinged to the module with respect to which it slides and maintained in inactive position by the tautness of the strap counteracting the force of a return spring pushing the locking system towards its active position;
- The locking system entails a guard or other type of lever mounted so as to be pivotal on the upper end of the intermediate element supporting the return pulley;
- The above pivoting lever has a bearing area for a pawl engaging a rack along the side of the upper module;
- The said pivoting lever is designed to prevent the upper module from being displaced with respect to the previous module by wedging it into an opening around the module presented by the lever for this purpose;

The locking system strictly speaking consists of a pawl with a pin is designed to cooperate with the teeth of a rack on the upper module;

The spring mentioned above acts indirectly on the pawl, with the spring pushing against one of the pulley support elements, the said support element being maintained in equilibrium when the strap is taut so that it stops the pawl from moving and keeps it in the said position of equilibrium.

It will be noted that in all the variants for constructing safety locking systems which, in accordance with the preferred workings of the invention, entails the cooperation of a tilting pawl with the tooth of a rack, the rack comprising any rigid linear element having a series of notches equivalent to rack teeth so that the pawl can engage if the strap breaks.

A passive safety system such as that described above can be usefully connected to an active safety system in which a return spring maintains a pawl in locked position and in which a cable can be used to release the pawl from the action of the return spring by means of manual controls so that the last module can be displaced.

Whatever the embodiment used for the strap safety locking system, the strap drive system in this invention can be combined usefully with a rack and pinion drive system between the very first mobile element of the telescopic pole and a base element in the series of modules, which remains fixed during operation. The rack and pinion drive system is produced as described in the applicant company's parallel patent application referred to herein, with its own safety locking system controlled by friction brake.

The lifting device according to the invention can consist of any number of modules in the telescopic mounting.

After a first rack and pinion system transferring movement to the first element of the module via a crank handle mounted on the base element to be manipulated by an operator, the transmission of movement from one module to the next is provided by a system comprising a strap mounted on a return pulley as explained above. The successive modules consist of sliding groups of three forming telescopic stages, each of which consists of three modules sliding one over the other with a strap in each stage kept taut between two fixation points located at the bottom of the first of the three modules (lower module of stage) and at the bottom of the last module in the group of three (upper module of stage) respectively and guided along a circuit including a pulley-type return device mounted on the upper end of the intermediate module between the lower module and the upper module.

In other words, in each stage of the telescopic mounting, the strap driving a module in row n is fixed to the said module at one end and to the module in row n−2 in the series at the other end, whilst being associated with a return pulley mounted on the intermediate module in row n−1.

It should be noted here that throughout this document, strap is to be taken in the broad sense of the term as designating any flexible, non extensible long narrow element, particularly cables, chains and belts.

BRIEF DESCRIPTION OF THE DRAWINGS

The invention will now be completely described in terms of its preferred features and their advantages, in reference to a single-stage, three-module telescopic pole, that is, with a base element, an intermediate element made up of the first mobile element, and an upper element forming the last element, as illustrated in the figures in the appended drawings, in which:

FIG. 1 illustrates the workings of a three-module telescopic lifting device according to the invention, with the device shown in extended position (FIG. 1*a*) and in stowed position (FIG. 1*b*);

FIGS. 5 to 7 are similar views to those of FIGS. 2 to 4, for a second embodiment;

FIGS. 13 to 15 are similar views to those of FIGS. 2 to 4, for a fourth embodiment;

FIGS. 16 to 17 are similar views to those of FIGS. 2 to 3, for a fifth embodiment;

DETAILED DESCRIPTION OF THE PREFERRED EMBODIMENT(S)

Figure 4:
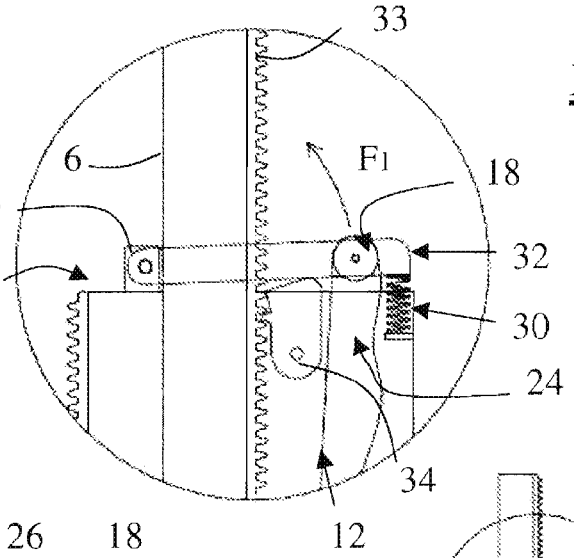
FIG. 4 is an enlargement of the locking system in FIG. 3.
Figure 2:
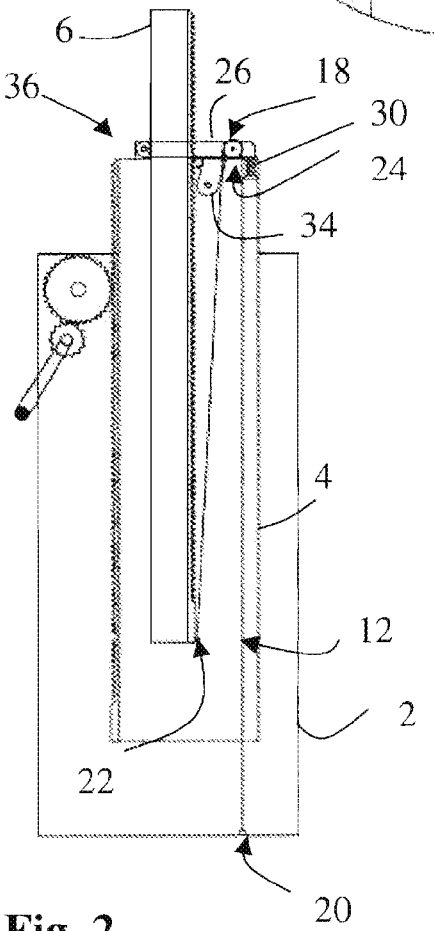
FIG. 2 is a view of the device in FIG. 1 in an intermediate extended position; the connection strap between the second and last module is not broken and the locking system is in free position.

In a first embodiment of the telescopic load lifting device as illustrated in FIGS. 1 to 4, the lifting device 1 comprises a last module 6 which is slidably movable along the previous intermediate module 4, and a base module 2 along which the said intermediate module 4 is designed to slide.

The three modules together form a telescopic stage whose extension is obtained by turning the crank handle 8 and by the combination of a rack and pinion 10 and a return strap 12.

The rack and pinion is used between the base module and the intermediate module. It can be described briefly as follows.

A gear reduction system connected to the crank handle (which can be fixed or removable) directly drives a rack 14 on the intermediate module. This is coupled with a self-locking friction brake system so that the position of the intermediate module sliding in relation to the base module is maintained whether the crank handle is activated or not. This system can be directly incorporated into the tube or mounted on the surface of the tube depending on the case. If necessary, the parallel European patent application already mentioned can be referred for a more explicit description of the mounting.

The gear reduction system consists of pinions fixed to a rotating spindle. The number, size and position of the pinions can vary. They are defined according to the load, speed and force required. Whatever the case, the system allows rotation of a drive pinion 16 positioned so that the pinion fits into the teeth of the rack on the intermediate module.

Rotation of the crank handle by muscular force transfers the force required to displace the intermediate module.

The return strap 12 is arranged so that extension of the intermediate module by turning the crank handle results in simultaneous displacement of the intermediate module, without any further action on the part of the user.

For this purpose, the strap is fixed to one end at the base of the base module of the pole (at its lower end) and it moves up inside the intermediate module in housing provided for this purpose up to a return pulley 18 positioned at the top of the intermediate module so that it can then go back down the intermediate module and be fixed at the base of the latter.

As illustrated in FIG. 1*a* and FIG. 1*b*, the strap can be broken down into two segments of variable lengths that are complementary to each other. A first segment 12*a* corresponds to the part of the strap which extends from the point of fixation of the strap to the base module 20 and pulley 18, while the second segment 12*b* corresponds to the rest of the strap, that is, the part which extends from the pulley and the point of fixation of the strap to the last module 22. The sum of the lengths of these two segments is always constant and equal to the length of the strap, which is not extensible. As a result, after displacement of the intermediate module and variation in the length of the first segment, the length of the second segment must vary by a complementary amount and the last module be displaced accordingly.

In stowed position (FIG. 1*b*), the intermediate module is completely retracted into the base module. The strap then has two virtually equal segments on either side of the return pulley. When the crank handle is turned and the intermediate module is pushed out by the rack and pinion drive system, the return pulley moves away from the bottom of the base module and the first strap segment gets longer while the second strap segment gets shorter. As a result, the lower end of the last module to which the end of the strap is fixed moves towards the pulley and the entire last module moves up, guided in its sliding movement by the intermediate module inside.

In this way, displacement of the intermediate module by the rack directly and proportionally causes displacement of the last module. Thanks to the resulting simultaneous displacement of all the modules, it is possible to ensure displacement of the load to be lifted with a force that remains constant for a given linear displacement, the operation usually being significantly faster than with a cable winch.

According to the invention, the strap thus combined with a return pulley 18 which guides it along a given circuit, is also coupled to a safety system 24 which locks the last module in place if the strap breaks.

The safety system comprises a lever which takes the form, in the present case, of a guard 26 covering the upper end of the intermediate module 4. The lever, or guard 26, is mounted pivotally on one end so that it can rotate around a spindle 28 fixed to the intermediate module, while the return pulley is fixed the other end. The safety system also comprises a return spring 30 which is compressed in an appropriate recess in the intermediate module. The spring is placed under the free end of guard 32, in contact with the guard. The spring tends to force the guard to rotate in the direction of the arrow F1 in FIGS. 3 and 4, thus pushing the free end of the guard away from the intermediate module.

The safety system also comprises a rack 33 on the last module, placed opposite a pawl forming a locking system 34. The pawl is mounted on the intermediate module, in such a way as to be able to move from an inactive position (FIG. 2) in which it does not engages with the rack (in which case it does not provide the locking function) to an active position (FIGS. 3 and 4) in which it engages with the rack to lock the last module in position. The pawl is optionally combined with a spiral spring, not shown here, which tends to force the pawl to pivot in such a way as to move closer to the rack. It can be observed that the pawl takes up an inactive position when its shape is such that it is prevented from moving by the guard, counteracting the spiral spring force. The active locking position of the pawl is obtained as soon as the guard is no longer able to stop the pawl from pivoting.

The return pulley 18 is coupled to the return spring 30 and made taut by strap 12.

During regular use, when the strap is in good repair, the spring 30 naturally tends to push against the guard and therefore the pulley which is solid with the guard. The pulley and guard together are then kept in position by the strap. A balance of forces is created between the thrust of the spring on the guard and the tension exerted on the pulley by the strap. In this position, the guard provides a support for the pawl and maintains it in inactive position.

Figure 3:
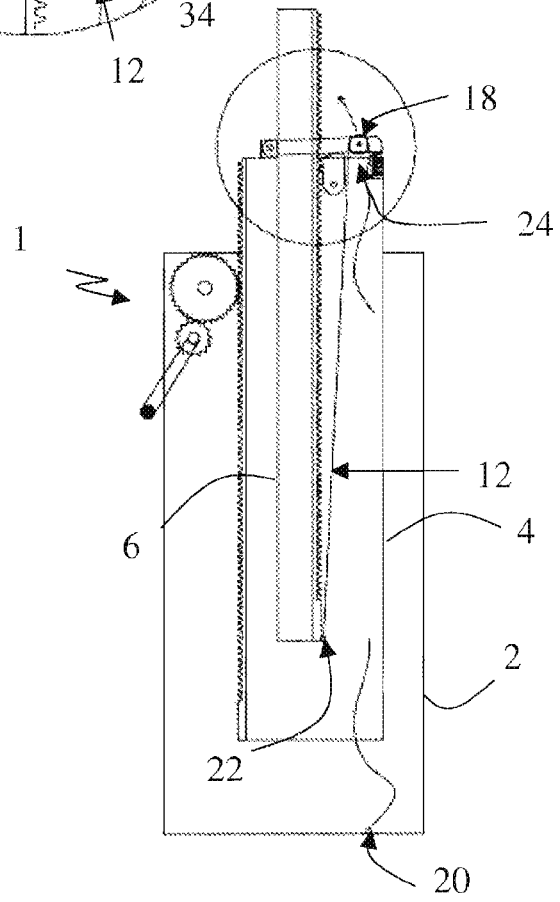
FIG. 3 is a similar view to that of FIG. 2, with the strap broken and the locking system in locked position.
Figure 10:
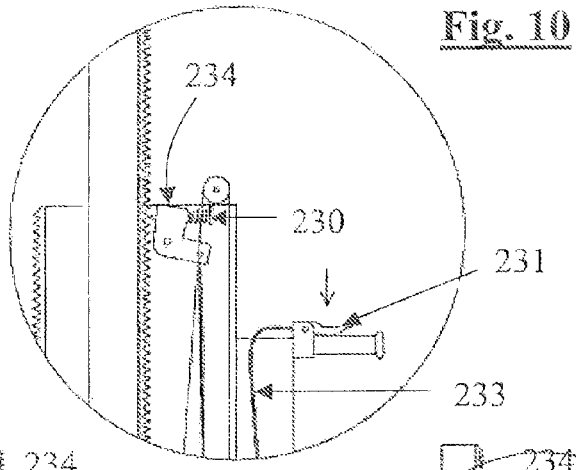
FIGS. 8 to 12 illustrate a third embodiment.
Figure 8:
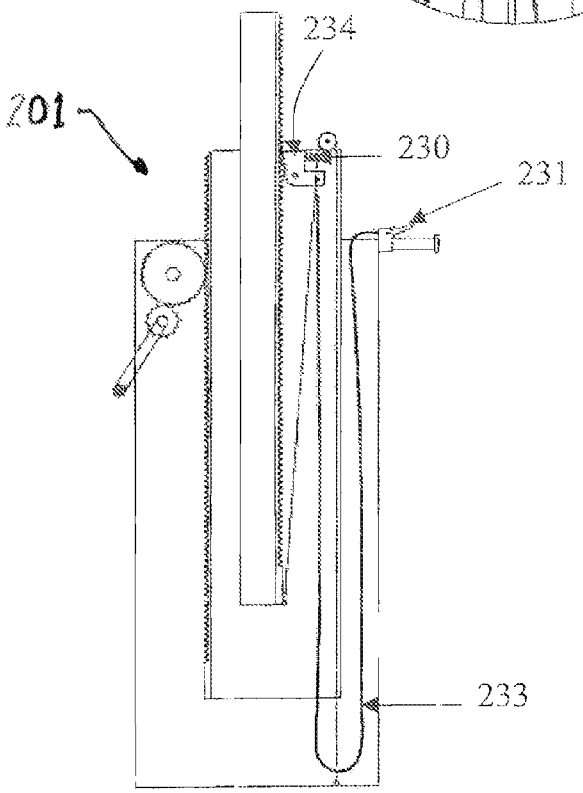
Figure 9:
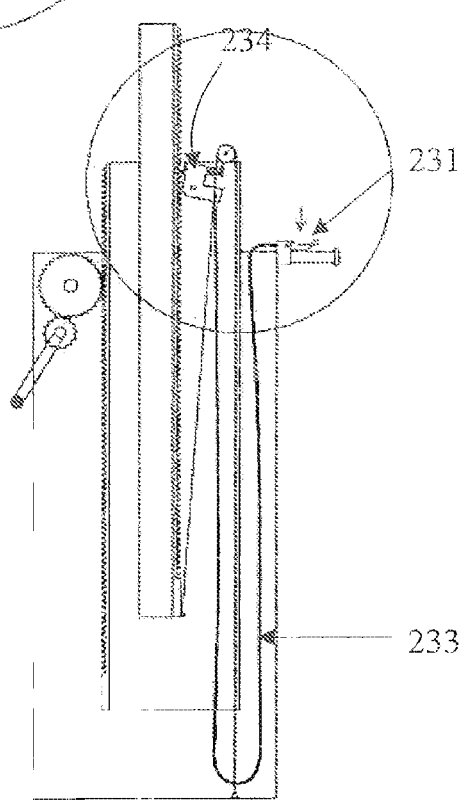

When the tension on the pulley ceases, after the strap breaks, for example, the compressed spring 30 is released. It then pushes against the end of the guard that was supporting it. The guard, the opposite end of which is hinged, is thus forced to pivot in the direction of arrow F1 (FIGS. 3 and 4). The movement of the guard releases the safety pawl which was supported by the guard and the spiral spring associated with the pawl instantly pushes it into active locking position.

According to the invention, a particularly effective safety system is thus produced which is triggered instantly when the strap breaks.

The safety system and the return pulley are placed at the upper end 36 of the intermediate module 4. It follows that in the unrepresented case of a four-module pole, that is, a pole with two intermediate modules that slide between the base module and the last module, the said system will be positioned on the upper end of each of the intermediate modules.

Each module usefully comprises an extruded tube with several functional compartments.

The base module has a sheath to guide the next module in translation, a recess to take the drive and gear reduction system and an attachment pin for the strap at the base of the base module.

The last module has a rack whose teeth project beyond the edge of the module and is designed to cooperate with the locking system associated with the intermediate module; it also has an attachment pin for the return strap. The module has a recess to take a stiffening tube.

Like the base module, the intermediate module has a sheath, designed here to take the last sliding module and, like the last module, it also has a rack. A groove is formed for this purpose between the walls of the intermediate module to lock the rack in position so that only the teeth project beyond the edge of the module, ready to be engaged by the drive pinion of the drive system. The intermediate module also has a compartment along the entire height of the module for the passage and protection of the return strap, one end of which is fixed to the attachment pin on the base module and the other to the attachment pin of the last module. Finally, the intermediate module includes the safety and return system described previously.

The modules are to be equipped with centring rings to facilitate displacement and reduce friction between each module, so that the force applied by the user is completely converted into displacement of the modules.

We will now describe a second embodiment for the invention, illustrated in FIGS. 5 to 7, in which the lift device 101 differs from the first embodiment described previously in that the safety system 124 does not have a guard. Pulley 118 is mounted so that it can move vertically and is kept under pressure against the return spring 130 by the taut strap. During normal use, it is assumed to be in equilibrium between the force exerted by the spring to push it away from the intermediate module, and the tension of the strap. The pawl 134 is hinged as above, and subjected to the elastic stress of the spiral spring which forces the pawl to pivot in such a way as to move closer to the rack. One end of the pawl is hinged to the pulley. When the strap is in good repair and provides sufficient tension for the pulley to be in equilibrium, the pawl is maintained in an inactive position. When the strap is broken, the pulley slides into an oblong guide hole in its spindle when the spring is released and no longer holds the pawl in place. The pawl is then pushed elastically towards the teeth of the rack under its own spring effect.

We will now describe a third embodiment for the invention illustrated in FIGS. 8 to 12. In accordance with the previous methods, the lifting device 201 comprises a three-module pole which has a rack on the last module and a safety system and strap return system on the intermediate module. Here, the safety system 224 comprises a pawl forming a locking system 234 which is hinged to the intermediate module, between an inactive position (FIGS. 9 and 10) in which the pawl is not engaged with the rack and does not prevent it from moving, and an active position (FIG. 8) in which the pawl is engaged with the rack to lock the last module in place. The pawl is directly pushed by the return spring 230 which tends to hold the pawl against the rack.

The free end of the pawl, opposite the end with the locking pin, is connected to a controller handle 231 by means of a cable 233, in a similar mounting to that of a bicycle brake cable. Pressure on the controller handle pulls the cable towards the handle and causes the pawl to pivot, which tends to disengage the pawl pin from the teeth of the rack, against the return spring force.

It can be observed here that the inactive position of the pawl is obtained by the user's manipulation of the controller handle and that it is the active position which is the basic position if the user does not take any action.

This results in an active safety system controlled by a handle thus creating a different mechanism from that of the return pulley. The pulley is independent of the return spring. The system can thus be triggered whether the strap is broken or not. If the strap breaks, the user can manually lock the last module into position.

Figure 11:
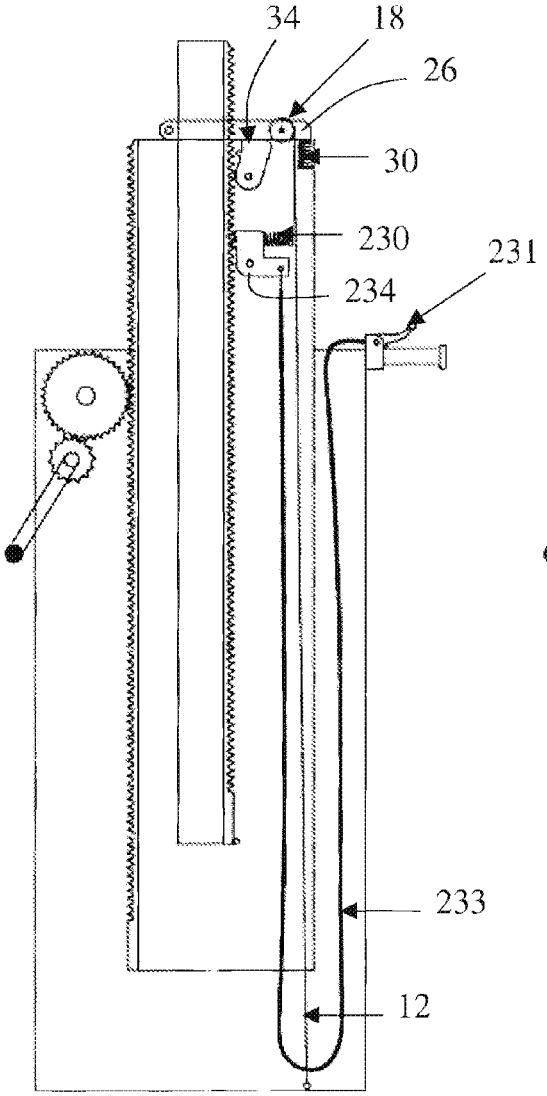
Figure 12:
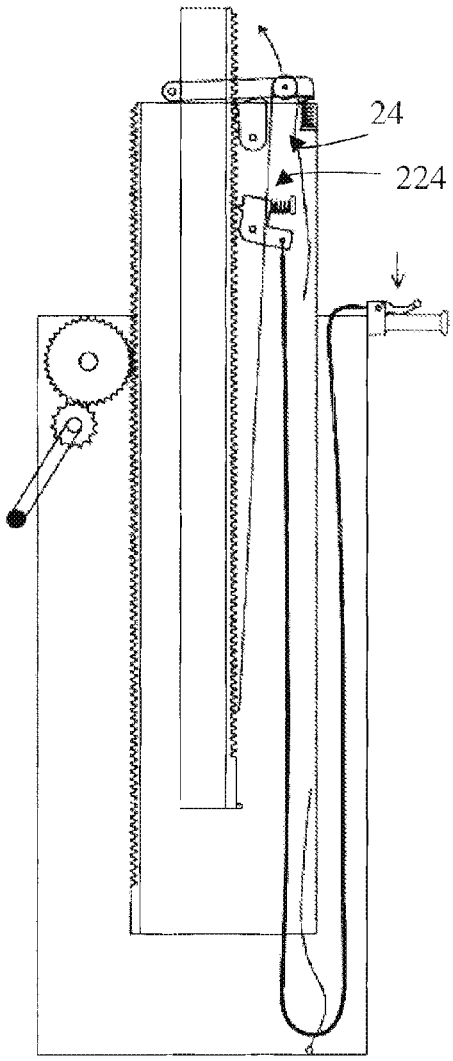

And usefully, in a variant illustrated in FIGS. 11 and 12, the active safety system can be combined with the passive locking system in the first embodiment of the invention.

We will now describe a fourth embodiment for the invention, illustrated in FIGS. 13 to 15, which differs from the first method described above in that the safety system 324 does not lock the last module in place by means of a pawl but by jamming the extruded section of the module itself. The guard 326 is mounted so as to be pivotal around a spindle 328 solid with the intermediate module, but is adjusted to fit around the last module. The opening through which the last module passes is dimensioned so that, when the guard tilts under the action of the spring after the strap breaks, the sides of the opening will push against the third tube and prevent it from sliding into the opening. This is where the guard plays the role of a locking system designed to prevent the module from moving under the force of the return spring released by the breaking of the strap. As a result, as illustrated in the figures, the last module does not need to be equipped with a rack.

We will now describe a fifth embodiment for the invention illustrated in FIGS. 16 and 17.

The telescopic system 401 differs here in that its modules, of which there are always three for a given telescopic stage, are no longer made of tubular sections mounted so as to remain inside each other as they slide into position. Here, they are placed side by side and guided so that they slide vertically in relation to each other.

The base module 402 and the intermediate module 404 are driven, as above, by a rack and pinion system, and the last module 406 slides along the intermediate module by means of the strap 412 which here is fixed between the upper part of the base module and an attachment pin 413 on the safety pawl 434, which is hinged to the last module. The strap passes above the intermediate module by means of one or several return pulleys, as illustrated by the two pulleys 418 and 419. When the intermediate module is extended, the end of the strap that is solid with the last module is pulled up towards to the return pulleys and takes the last module with it. At the same time, the strap pulls on the safety pawl and the pawl hinge causes it to counteract the force of the return spring 430, which tends to push the pawl directly into the rack teeth. It should be noted that m when this embodiment is used the intermediate module has two racks, one for the drive system 414 and the other for the locking system 415. When the strap breaks (FIG. 16), no force is exerted against the return spring which forces the pawl up against the rack and prevents the last module from going down in relation to the intermediate module.

Figure 18:
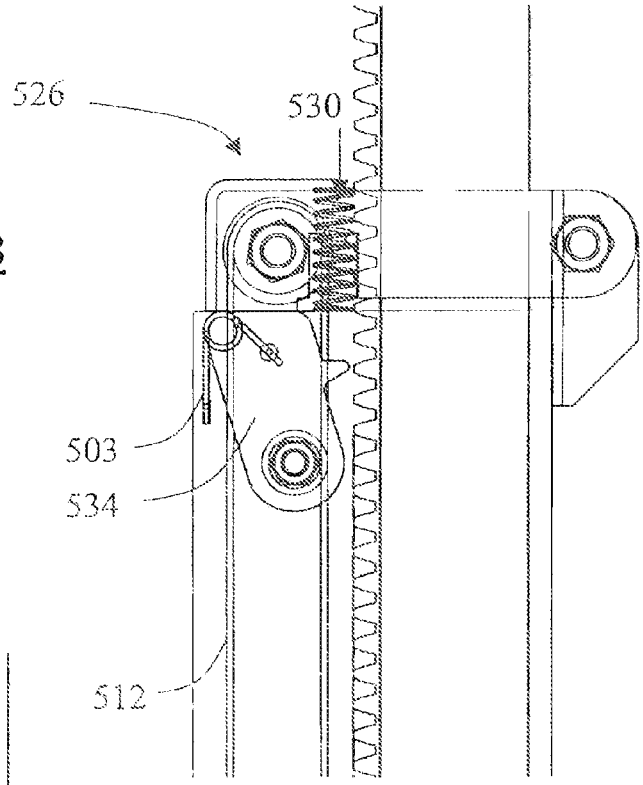
FIGS. 18 and 19 provide a more detailed illustration of the embodiment depicted in FIGS. 1 to 4, before and after breaking of the strap respectively.
Figure 19:
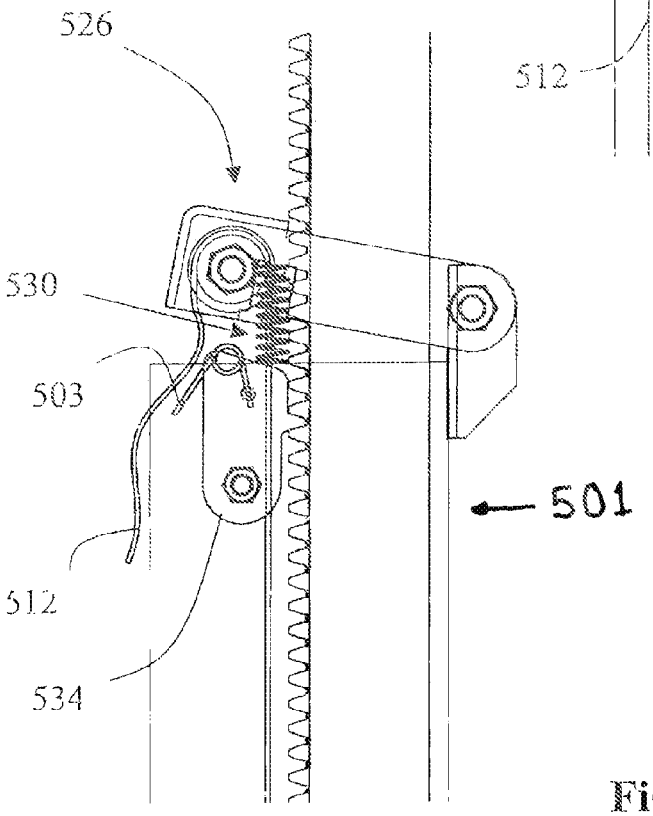

FIGS. 18 and 19 show a lift device bearing the reference 501, that is, the same device as that in FIGS. 1 and 4. The return spring 530 of the pivoting lever is shown in the position it occupies during normal operation, before the strap 512 breaks. It can be seen that it is protected inside the guard 526 forming the lever. Pawl 534 can also be seen, locked in inactive position by the guard in FIG. 18, and which, in FIG. 19, is in the safety position towards which it is pushed by the spiral spring 503.

The description above clearly explains how the invention is able to achieve its objectives. It is nevertheless clear that the invention is not limited to the embodiments specifically described and illustrated.

The invention claimed is:

1. A lifting device with a telescopic pole comprising at least three successive modules mounted so that the modules slide vertically with respect to each other, wherein a drive strap transfers movement in order to extend an upper module of said successive modules with respect to an intermediate module of said successive modules between a lower module and said upper module when the intermediate module is caused to move with respect to said lower module of said successive modules, said drive strap being kept taut between two fixation points placed respectively on said lower module and said upper module and passing along return pulley means mounted on said intermediate module, wherein a safety system which is normally maintained in inactive position by the tension of said drive strap is automatically released into active locking position to prevent said upper module from continuing to move with respect to said intermediate module if said drive strap breaks, wherein said safety system comprises a locking system which is hinged to said intermediate module and which is maintained in a locking system inactive position by the tension of said drive strap counteracting the force of a return spring which tends to push said locking system towards a locking system active position, wherein said locking system consists of a pawl comprising a locking pin designed to cooperate with teeth of a rack arranged on said upper module, and wherein said return spring acts indirectly on said pawl, said return spring tending to push up a pulley support element which is maintained when said drive strap is taut in such a position of equilibrium that said support element stops said pawl in a pawl inactive position.

2. A lifting device with a telescopic pole comprising at least three successive modules mounted so that the modules slide vertically with respect to each other, wherein a drive strap transfers movement in order to extend an upper module of said successive modules with respect to an intermediate module of said successive modules between a lower module and said upper module when the intermediate module is caused to move with respect to said lower module of said successive modules, said drive strap being kept taut between two fixation points placed respectively on said lower module and said upper module and passing along return pulley means mounted on said intermediate module, wherein, for a first stage of said three successive modules, said lower module constitutes a base module for said telescopic pole, and the movement of said intermediate module with respect to said lower module is provided by a crank-activated rack-and-pinion drive system, wherein a safety system which is normally maintained in inactive position by the tension of said drive strap is automatically released into active locking position to prevent said upper module from continuing to move with respect to said intermediate module if said drive strap breaks, wherein said safety system comprises a locking system which is hinged to said intermediate module and which is maintained in a locking system inactive position by the tension of said drive strap counteracting the force of a return spring which tends to push said locking system towards a locking system active position, wherein said locking system consists of a pawl comprising a locking pin designed to cooperate with teeth of a rack arranged on said upper module, and wherein said return spring acts indirectly on said pawl, said return spring tending to push up a pulley support element which is maintained when said drive strap is taut in such a position of equilibrium that said support element stops said pawl in a pawl inactive position.

* * * * *